US009718066B2

(12) United States Patent
Hartmann et al.

(10) Patent No.: US 9,718,066 B2
(45) Date of Patent: Aug. 1, 2017

(54) METHOD FOR SEPARATING A DEFINED MINERAL PHASE OF VALUE FROM A GROUND ORE

(71) Applicant: SIEMENS AKTIENGESELLSCHAFT, Munich (DE)

(72) Inventors: Werner Hartmann, Weisendorf (DE); Theresa Stark, Aachen (DE); Sonja Wolfrum, Erlangen (DE); Hermann Wotruba, Aachen (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 14/770,059

(22) PCT Filed: Dec. 15, 2014

(86) PCT No.: PCT/EP2014/077692

§ 371 (c)(1),
(2) Date: Aug. 24, 2015

(87) PCT Pub. No.: WO2015/091324

PCT Pub. Date: Jun. 25, 2015

(65) Prior Publication Data

US 2016/0008822 A1 Jan. 14, 2016

(30) Foreign Application Priority Data

Dec. 20, 2013 (DE) ..... 10 2013 226 845
Jan. 13, 2014 (DE) ..... 10 2014 200 415

(51) Int. Cl.
*B03C 1/00* (2006.01)
*B03C 1/30* (2006.01)
(Continued)

(52) U.S. Cl.
CPC ..... *B03C 1/30* (2013.01); *B03B 1/04* (2013.01); *B03B 7/00* (2013.01); *B03B 9/00* (2013.01);
(Continued)

(58) Field of Classification Search
CPC .... B03B 1/04; B03B 7/00; B03C 1/30; B03C 9/00; B03D 1/085; B03D 2201/18; B03D 2203/02
(Continued)

(56) References Cited

U.S. PATENT DOCUMENTS 4,144,164 A * 3/1979 Absil ..... B03B 5/44 209/17
4,802,976 A * 2/1989 Miller ..... B03B 9/005 209/166
(Continued)

*Primary Examiner* — Joseph C Rodriguez
*Assistant Examiner* — Kalyanavenkateshware Kumar
(74) *Attorney, Agent, or Firm* — Slayden Grubert Beard PLLC

(57) ABSTRACT

A defined mineral phase is separated from a ground ore having several chemical phases and being present in a heterogeneous particle size distribution by classifying the ore according to a defined particle diameter into at least two fractions, a first fraction having particles essentially larger than the defined particle diameter and a second fraction having particles essentially smaller than the defined particle diameter, and the defined mineral particles of value being present in both fractions, floating the first fraction having the greater particle diameters and selecting the defined mineral particles of value in a flotation concentrate, selectively admixing the defined mineral particles of value in the fraction having the smaller particle diameters with magnetizable particles, applying a magnetic separation process to the second fraction having smaller particle diameters, and separating a concentrate with an enrichment of the defined mineral phase of value.

17 Claims, 1 Drawing Sheet

(51) Int. Cl.

| | |
|---|---|
| ***B03B 1/04*** | (2006.01) |
| ***B03B 7/00*** | (2006.01) |
| ***B03B 9/00*** | (2006.01) |
| ***B03D 1/08*** | (2006.01) |

(52) U.S. Cl.
CPC ..... *B03D 1/085* (2013.01); *B03C 2201/18* (2013.01); *B03D 2203/02* (2013.01)

(58) Field of Classification Search
USPC ..... 209/3.8, 38, 215, 172.5, 176
See application file for complete search history.

(56) References Cited

U.S. PATENT DOCUMENTS

| | | | | |
|---|---|---|---|---|
| 8,342,336 | B2 * | 1/2013 | Diez | B03C 1/015 209/3 |
| 2010/0003167 | A1 * | 1/2010 | Paul | G01N 33/54326 422/82.01 |
| 2015/0298137 | A1 * | 10/2015 | Manepalli | B02C 23/10 241/20 |

* cited by examiner

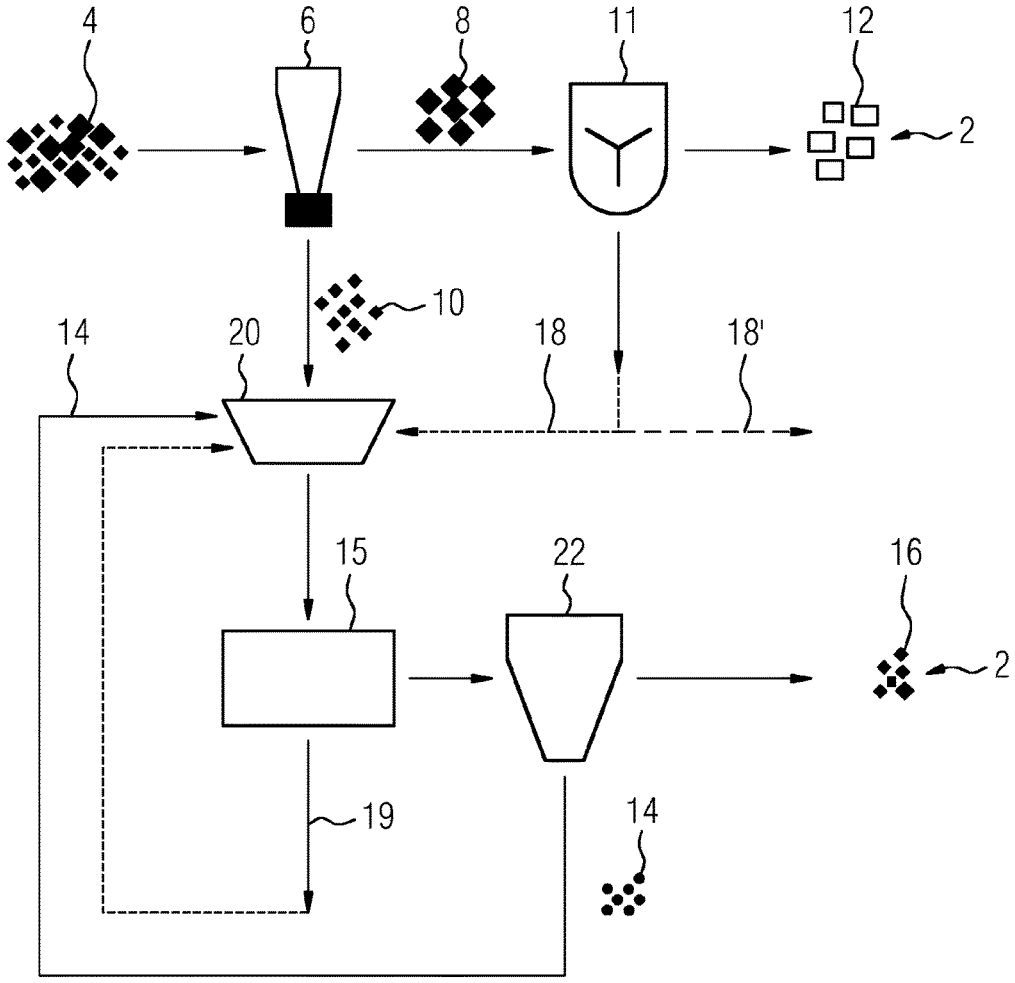
4
6
8
11
12
2
10
14
20
18
18'
15
22
16
2
19
14

METHOD FOR SEPARATING A DEFINED MINERAL PHASE OF VALUE FROM A GROUND ORE

CROSS REFERENCE TO RELATED APPLICATIONS

This application is based on and hereby claims priority to International Application No. PCT/EP2014/077692 filed on Dec. 15, 2014 and German Application Nos. 10 2013 226 845.9 filed on Dec. 20, 2013 and 10 2014 200 415.2 filed on Jan. 13, 2014, the contents of which are hereby incorporated by reference.

BACKGROUND

Separating out defined phases of a useful mineral, which in particular are present in the ore with a very fine distribution, from a ground ore always represents a technical problem. This finely distributed presence of useful phases in an ore arises particularly in the case of rare earth phases, but also for other conventional metallic phases, such as copper minerals. Because this separation problem arises more frequently in the case of rare earth elements or rare earth compounds in mineral rock, the description herein more particularly focuses on the extraction of rare earths. However, the method described below can basically be applied to numerous extraction processes for other metals.

The rare earths occur naturally in various minerals, always in an oxidized form, for example as carbonates or phosphates. Although there are numerous minerals, 95% of the world's rare earth resources consist of the three minerals bastnasite, monazite and xenotime. It is characteristic of rare earth minerals that they contain the entire spectrum of rare earth elements. Due to this association, and the great similarity of the rare earth elements in their chemical behavior, the requirements to be met by the process for the separation the individual substances are very demanding. In the case of the rare earth minerals, one characteristic feature which is always technically challenging consists in the fact that in the ore they are generally very finely interspersed, as a result of which the beneficiation process must in addition meet highly demanding requirements. Thus the ore must on the one hand be adequately crushed in order to achieve a sufficient level of exposure of the useful materials. On the other hand, very fine grain sizes often make more difficult the extraction of the useful materials during the production of a concentrate (flotation). In addition to this there is the fact that a large area is required for the quantities of waste material which arise (the flow of waste material, or gangue, referred to below as tailings). A further property of the rare earths is that they are frequently interspersed with such radioactive contaminant materials as thorium and uranium. These are also released during the beneficiation, so that there are also environmental risks. Due to these ecological and economic problems, many deposits of rare earth minerals are nowadays not mined.

In the beneficiation of bastnasite, a typical ore containing rare earth minerals, after the ore has been crushed the broken pieces are ground down to a size suitable for flotation, of less than 150 micrometer. This process involves substantial energy costs. In general, the target grain size for the grinding is determined according to the exposed grain size of the rare earth mineral. This is heavily dependent on the ore type and the deposit concerned. The term exposed grain size is to be understood here as the size of grain in which the individual mineral phases are present as individual grains. Basically, an exposure of 100% should be the aim, in reality it may be that exposures of 50%-70% are realistic, depending on the deposit. If the crushing produces pieces smaller than the exposed grain size, that is the grain size at which the individual mineral phases are present as separate pieces, this is overgrinding of the particles and results in the formation of a high proportion of fine particles. These can often not be extracted by the subsequent flotation, which is used to separate the useful material and the valueless material (gangue, tailings), or can even have a negatively detrimental effect on the process. On the other hand, if the exposed grain size is exceeded, the mineral will not be present in a completely free state, so that the interaction between the surface of the mineral and the chemical agents is reduced or prevented. As a result, the useful material which is to be extracted cannot adhere adequately to the rising gas bubbles during the flotation and thus become enriched in the foam zone of the upper surface of the liquid.

Apart from the efficiency of the extraction, the yield (recovery) from the flotation has a decisive influence on the efficiency of the overall process for the extraction of rare earths. The higher is the yield of rare earths, and hence the enrichment of rare earths in the concentrate, the lower is the loss of useful material in the process. Presently, it is possible to achieve yield levels for rare earths of 65%-70%. But it also follows that 30%-35% of the rare earth materials which are contained in the initial ore are not floated off, and get lost in the tailings. One reason for this is the poor buoyancy of fine particles of material, in particular particles with a grain size of less than 20 micrometers are affected by this. The main reason for this is the low collision efficiency between small particles and gas bubbles. In addition, small particle sizes require a large bubble surface area to bind on the particles of useful material, which with conventional flotation can only be achieved with a high proportion of very small gas bubbles. However, these are in turn not suitable for transporting the larger particles of useful material into the foam layer and in addition, in a conventional flotation process (stirred or mechanical cells; columnar cell), can only be produced at substantial energy cost.

In order to provide a remedy for this, two approaches are applied in principle. One consists in increasing the size of the particles of useful material, or in reducing the size of the gas bubbles. For the purpose of increasing the particle sizes, use is made of selective flocculation, coagulation and hydrophobic aggregation of the particles. These methods require additives such as polymers or electrolytes, and are already being used industrially. By comparison with electrolytes, the advantage of added polymers is their high selectivity, they bind solely with the particles of useful material, and not with the valueless material. However, there are frequently inclusions of gangue (tailings) in the interstices in the aggregates which are formed. Reduction in the size of the gas bubbles is the approach used, for example, in dissolved gas flotation, in electro-flotation and in turbulent micro-flotation. Because the gas bubbles are small, low speeds of upward movement are achieved, so that the small particles can remain attached during the upward movement. However, this results in long residence times for the useful material in the flotation cell. Apart from this, the low speeds of upward movement can have a negative effect on the selectivity.

SUMMARY

The method described below improves the yield of mineral phases, for useful materials which are present in finely distributed form in a ground ore, by comparison with that of the flotation methods in the prior art.

Described below is a method for separating out a defined mineral phase of a useful material from a ground ore.

The method described below serves to separate out a defined mineral phase of a useful material, essentially a phase of a rare earth mineral, but also to separate out other metallic ores such as copper from a ground ore. Here, the ground ore has several chemical phases and the grain sizes are heterogeneous.

First, the ore is classified, whereby a particle diameter is defined and at least two fractions are produced, where one fraction has particles with diameters which are essentially larger than the defined particle diameter and the second fraction has particles which are essentially smaller than the defined particle diameter. The term 'essentially' has been added in here because it is not possible commercially to produce an arbitrary separation into two fractions at an exact discrete particle diameter. The possibility cannot be excluded that the fraction with the larger diameter particles also contains particles which are nominally smaller than the defined particle diameter, and vice versa.

The fraction with the larger diameter particles is fed into a known flotation process, and the mineral particles of useful material are selectively enriched in a flotation concentrate. In addition, the mineral particles of useful material in the second fraction which have the smaller particle diameter are selectively associated with magnetizable particles (in what follows referred to by the generic term "magnetite", although other suitable magnetic materials which are adequately chemically inert like magnetite $Fe_3O_4$ can also be used) and are then subject to a magnetic separation process. The result is a concentrate with an enrichment of the defined mineral phase of the useful material, which is however present with a smaller particle diameter.

By comparison with the prior art, in which all the particles of the ground ore are concentrated using a known flotation process, an advantage of the method described herein lies in the selective differentiation into at least two particle fractions and concentrating the smaller particle fraction using a magnetic separation process. By comparison with the known flotation process, in which the size of the gas bubbles limits the ore particles which can be selected, it is possible on the one hand to use magnetite particles with a small diameter in the magnetic separation, by which means the specific surface area is increased and hence more surface area is available for binding on the useful material. On the other hand, a greater separating power can be used to separate the attached magnetite particles in the magnetic field than with the small gas bubbles in a flotation process. A further advantage of magnetic separation consists in the selective controllability of the distribution of the sizes of the magnetite grains. Thus, by comparison with the production of gas bubbles, it is simpler to tailor the size distribution of the magnetite to the useful material which is to be separated out, so that the yield can be substantially increased.

A further advantage of the combination of flotation and magnetic separation in the beneficiation of rare earths is that two different tailing flows are obtained. The tailing flows from the magnetic separation, which contain rather fine particles, generally contain also the majority of environmentally damaging substances, such as for example thorium or heavy metals, because these environmentally damaging substances are also separated out during the classification. If this is so, the result of having the two separate tailing flows which are obtained is a significantly smaller volume requirement for the storage of the critical substances.

In known processes, both the fine ore particles and also the coarse ones are fed to the flotation, as a result of which it is only possible to achieve yields of 65%-70%. By the combination of flotation and magnetic separation described herein it is possible to significantly increase the overall yield of rare earths, depending on the ore and the deposit (depending on the ore by 5%-15%) and hence to have a positive effect on the efficiency of the beneficiation processes. As a consequence, it can then become economically worthwhile to mine various rare earth deposits which until now have not been considered.

In various embodiments described herein, a tailing flow which arises with the flotation is, at least partially, fed to the magnetic separation process. It has been found that the magnetic separation process is also entirely compatible with a wider spectrum of grain size distribution, so that particles of the useful material or phases or the useful material which it was not possible to successfully separate out with the flotation can be subject to separation once more by a further alternative process.

It has been found to be advantageous that the defined particle diameter which is set during classification is smaller than 70 micrometer. In particular it is less than 50 micrometer. Here, use is made in particular of a hydrocyclone for the classification. Other classification processes, such as sieving, spiral conveyors etc., are also possible.

The method described herein can be applied to mineral particles of useful materials from the rare earth series. The term rare earths is to be understood as compounds of the rare earth elements, in particular their oxides, but also carbonates and phosphates. The term rare earth elements means, in particular, the so-called lanthanides, including lanthanum, cerium, praseodymium, neodymium, samarium, europium, gadolinium, terbium, dysprosium, holmium, erbium, ytterbium and lutetium, but yttrium and scandium are also included here in this case because of their chemical similarities. Rare earths are in turn compounds of rare earth elements, in particular their oxides and phosphates.

BRIEF DESCRIPTION OF THE DRAWINGS

These and other objects and advantages will become more apparent and more readily appreciated from the following description of the various embodiments, taken in conjunction with the accompanying drawings of which:

FIG. 1 shows a process for the separation of a mineral particle of useful material, that is a ground ore, making use of a combination of flotation and magnetic separation.

DETAILED DESCRIPTION OF THE PREFERRED EMBODIMENT

Reference will now be made in detail to the various embodiments, examples of which are illustrated in the accompanying drawings, wherein like reference numerals refer to like elements throughout.

Referring to FIG. 1, an embodiment of the method for separating out a phase of a useful material 2 from a ground ore 4 is described below by way of example. The ore 4 is ground in accordance with a known process, in which a heterogeneous distribution of grain sizes for the individual particles inevitably arises. The grinding classification, and with it the extent or level of exposure, are dependent on the deposit, or on the phase sizes present in it, of the useful material phase 2 which is to be separated out. However, even for these phase sizes of the useful material phase 2 there is also a phase size distribution curve, so that it is expedient to classify the ground ore 4 into two fractions. This takes place in a classification facility 6, in which on the one hand a first fraction 8 is produced, this having a distribution of grain sizes which is essentially larger than 50 micrometer. Further, in the classification facility 6, which can take the form of a hydrocyclone, a second fraction 10 is separated out, this having particle sizes which lie essentially below 50 micrometer. It is basically possible to produce yet further fractions which have different grain size distributions, if it is thereby possible to optimize technically the selection process.

The first fraction 8 with the larger diameter particles is now passed into a flotation facility 11, which represents a known flotation facility. The flotation produces a flotation concentrate 12, which contains an enrichment of the useful material phase 2. Depending on the flotation method, and depending on the nature and constitution of the ground ore, the level of the yield of the useful material phase 2 in the flotation concentrate will vary. For this reason, it may be expedient to apply the flotation process 11 more than once.

In parallel with this, the second fraction 10 of the ground ore 4 is passed to a magnetic separation process. For this purpose, a chemical conditioning 20 of the particles in the fraction 10 is first carried out, where this conditioning 20 is known per se and will therefore not be further discussed here. It will only be said that the particles of useful material are brought together with organic substances which have a selective effect, which attach themselves to the surface of the particles of useful material and hence influence the characteristics of their surface. Also introduced during the conditioning is surface treated magnetite ($Fe_3O_4$) or some other magnetic phase, which is taken up by the selectively surface treated particles of useful material 2. In a downstream magnetic separation reactor 15, the particle agglomerates, including magnetite particles 14 and the particles of useful material 2, are separated out. In the course of this, a tailing flow 19 arises, which can be fed once again into the magnetic separation process. This will depend on how high the yield is, of particles of useful material, after the first separation process in the separation reactor 15. After the magnetite particles have been separated out from the second fraction 10 in a separation apparatus, the magnetite particles 14, which are bonded to the particles of useful material 2, are separated off again at separation 22 from the particles of useful material 2, so that on one side a magnetic separation concentrate 16 with particles of useful material 2 results, on the other side the magnetite particles 14 are retrieved and fed back again to the conditioning process 20.

For various ores it has been found that if the tailing stream 18, which arises from the flotation 11, still contains a high enough proportion of particles of useful material 2 it is also expedient to feed this additionally to the magnetic separation process. On the other hand, this implies of course that in this case the yield from the flotation 11 was not yet at a satisfactory level. It has been found that, in respect of a wider distribution of grain sizes, magnetic separation 15 is less temperamental than flotation 11. Basically however, the tailing flow 18 can also be discarded in the form of 18' and stored permanently in an appropriate disposal site, or at this point it is also possible to separate out particles of other alternative useful materials.

It has further been established that environmentally critical substances in the ground ore 4, in particular radioactive particles such as uranium oxide or thorium dioxide, are also present with a very fine distribution in the ground ore 4, so that a large proportion of these environmentally damaging substances accumulate in the second fraction 10. These are then left behind in the tailing flow 19 and can be permanently stored separately from the tailing flow 18. This is particularly advantageous because of the fact that the tailing flow 19 which results from the magnetic separation has, by comparison with to the tailing flow 18 or the tailing flow 18' which results from the flotation process, a comparatively smaller volume. If the enrichment of the environmentally damaging substances in this tailing flow 19 is greater, this comparatively small tailing flow can be stored separately in a disposal site selected for this purpose, so that the environmentally damaging products which arise with the mining of rare earth elements can be stored separately in a smaller fraction, which significantly reduces the environmental impact.

The various embodiments have been described in detail with particular reference and examples, but it will be understood that variations and modifications can be effected within the spirit and scope of the various embodiments covered by the claims which may include the phrase "at least one of A, B and C" as an alternative expression that means one or more of A, B and C may be used, contrary to the holding in *Superguide* v. *DIRECTV,* 69 USPQ2d 1865 (Fed. Cir. 2004).

The invention claimed is:

1. A method for separating useful material from a ground ore having several chemical phases and heterogeneous grain sizes, the method comprising: classifying ore particles of the ground ore into one of two fractions, the ore particles in a first fraction having first particle diameters substantially larger than a defined particle diameter and the ore particles in a second fraction having particle diameters substantially smaller than the defined particle diameter, both the first and second fractions containing mineral particles of the useful material; subjecting the first fraction to a flotation process to produce a flotation concentrate including enriched particles of the useful material; mixing the second fraction with magnetizable particles; separating bonded particles of the useful material in the second fraction that have bonded with the magnetizable particles from unbonded magnetizable particles that have not bonded with the mineral particles of the useful material; and separating the mineral particles of the useful material in the second fraction, that have bonded with the magnetizable particles and have been separated from the unbonded magnetizable particles, from the magnetizable particles to produce a magnetic separation concentrate containing the particles of the useful material.

2. The method as claimed in claim 1, wherein the flotation process produces a tailing stream, and wherein the method further comprises combining the tailing stream with the second fraction after said classifying.

3. The method as claimed in claim 2, wherein the defined particle diameter is less that 70 μm.

4. The method as claimed in claim 3, wherein the defined particle diameter is less that 50 μm.

5. The method as claimed in claim 1, wherein the classifying is performed using a hydrocyclone.

6. The method as claimed in claim 5, wherein the mineral particles of the useful material are derived from salts of the lanthanides.

7. The method as claimed in claim 1, wherein the mineral particles of the useful material are derived from layers of the rare earths.

8. The method as claimed in claim 1, wherein the defined particle diameter is less that 70 μm.

9. The method as claimed in claim 1, wherein the defined particle diameter is less that 50 μm.

10. The method as claimed in claim 1, wherein the mineral particles of the useful material are derived from salts of the lanthanides.

11. The method as claimed in claim 1, further comprising, prior to said mixing, chemical conditioning the second fraction so that organic substances are attached to the surfaces of the mineral particles of the useful material in the second fraction.

12. The method as claimed in claim 11, wherein the flotation process produces a tailing stream, and wherein the method further comprises combining the tailing stream with the second fraction during the chemical conditioning.

13. The method as claimed in claim 11, wherein the classifying is performed using a hydrocyclone.

14. The method as claimed in claim 11, wherein the mineral particles of the useful material are derived from layers of the rare earths.

15. The method as claimed in claim 11, wherein the mineral particles of the useful material are derived from salts of the lanthanides.

16. The method as claimed in claim 11, wherein the defined particle diameter is less that 70 μm.

17. The method as claimed in claim 11, wherein the defined particle diameter is less that 50 μm.

* * * * *